US010960679B2

(12) United States Patent
Yajima et al.

(10) Patent No.: US 10,960,679 B2
(45) Date of Patent: Mar. 30, 2021

(54) INKJET PRINTER

(71) Applicant: SEIKO EPSON CORPORATION, Tokyo (JP)

(72) Inventors: Yasushi Yajima, Minowa-machi (JP); Hiroyuki Kobayashi, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/523,157

(22) Filed: Jul. 26, 2019

(65) Prior Publication Data

US 2020/0039231 A1 Feb. 6, 2020

(30) Foreign Application Priority Data

Jul. 31, 2018 (JP) ..... JP2018-143271

(51) Int. Cl.
*B41J 2/19* (2006.01)
*B41J 2/175* (2006.01)
*B41J 29/13* (2006.01)

(52) U.S. Cl.
CPC ..... *B41J 2/19* (2013.01); *B41J 2/1752* (2013.01); *B41J 2/17509* (2013.01); *B41J 2/17523* (2013.01); *B41J 2/17566* (2013.01); *B41J 29/13* (2013.01)

(58) Field of Classification Search
CPC ..... B41J 2/19; B41J 2/17566; B41J 2/17509; B41J 2/1752; B41J 2/17523; B41J 29/13
See application file for complete search history.

(56) References Cited

U.S. PATENT DOCUMENTS 8,360,552 B2 * 1/2013 Justice ..... B41J 2/1752 347/37
8,388,119 B2 * 3/2013 Nishimori ..... B41J 2/17513 347/84
2013/0135401 A1 5/2013 Kobayashi et al.

FOREIGN PATENT DOCUMENTS

JP 2013-111801 A 6/2013

* cited by examiner

*Primary Examiner* — Geoffrey S Mruk
(74) *Attorney, Agent, or Firm* — Workman Nydegger

(57) ABSTRACT

An inkjet printer comprising: an ink storage that communicates with a nozzle from which ink is ejected; a carriage that moves along a guide member and has the ink storage mounted thereon; an ink tube through which ink supplied to the ink storage passes; and a coupling member that connects the ink storage and the ink tube; wherein the carriage has a first wall located at a position that is in a first direction from the coupling member, and a second wall located at a position that is in a second direction from the coupling member, the first direction and the second direction being along the direction of carriage movement, and the second direction being opposite the first direction, and when viewed in the direction of carriage movement, the coupling member is superimposed with the first wall and is superimposed with the second wall.

6 Claims, 6 Drawing Sheets

INKJET PRINTER

CROSS-REFERENCE TO RELATED APPLICATION

This application is based upon Japanese Patent Application 2018-143271 filed on Jul. 31, 2018, the entire contents of which are incorporated by reference herein.

BACKGROUND

The present disclosure relates to an inkjet printer.

Image forming devices that record images by ejecting fluid using a recording head configured to eject fluid (ink) are known from the literature. See, for example, JP-A-2013-111801.

The image forming device (inkjet printer) described in JP-A-2013-111801 has a head tank that stores the ink that is supplied to the recording head, a carriage that carries the recording head and head tank, a main tank that stores ink that is supplied to the head tank, a displacement member that changes position according to how much ink remains in the main tank, and a fluid conveyance means that supplies ink from the main tank to the head tank through a supply tube (ink tube), and ink is supplied from the main tank to the head tank based on a sensor detecting the position of the displacement member.

SUMMARY

In the inkjet printer described in JP-A-2013-111801, a coupling member that connects the head tank to the ink tube is disposed off the carriage at the top of the head tank. As a result, the coupling member may collide with other members when the carriage travels in the scanning direction, and connection of the head tank and ink tube by the coupling member may be broken by the collision.

According to present disclosure, an inkjet printer comprising: an ink storage that communicates with a nozzle from which ink is ejected; a carriage that moves along a guide member and has the ink storage mounted thereon; an ink tube through which ink supplied to the ink storage passes; and a coupling member that connects the ink storage and the ink tube; wherein the carriage has a first wall located at a position that is in a first direction from the coupling member, and a second wall located at a position that is in a second direction from the coupling member, the first direction and the second direction being along the direction of carriage movement, and the second direction being opposite the first direction, and when viewed in the direction of carriage movement, the coupling member is superimposed with the first wall and is superimposed with the second wall.

In an inkjet printer according to another aspect of the present disclosure, the carriage has a cover member configured to cover the coupling member, the coupling member being interposed between the cover and the ink storage.

An inkjet printer according to another aspect of the present disclosure embodiment may include a filter configured to capture bubbles in the ink tube and is disposed to the ink tube. And the filter is fastened to the carriage.

In an inkjet printer according to another aspect of the present disclosure, the ink tube is fastened to the carriage.

An inkjet printer according to another aspect of the present disclosure embodiment may include a filter configured to capture bubbles in the ink tube and is disposed to the ink tube between a part of the ink tube fastened to the carriage and the coupling member.

In an inkjet printer according to another aspect of the present disclosure, the first wall has a slope that inclines to a plane perpendicular to the direction of carriage movement.

In an inkjet printer according to another aspect of the present disclosure, the slope has a rib.

In an inkjet printer according to another aspect of the present disclosure, the first wall has an impact resistant structure.

Other objects and attainments together with a fuller understanding of the invention will become apparent and appreciated by referring to the following description and claims taken in conjunction with the accompanying drawings.

DESCRIPTION OF EMBODIMENTS

Embodiments of the invention are described below with reference to the accompanying figures. These embodiments describe desirable embodiments of the invention, do not limit the invention, and can be varied as desired within the technical scope of the invention. Furthermore, in the accompanying figures, layers and parts are sized to enable recognition thereof in the figures, and the scale of the layers and parts differs from the actual scale.

EMBODIMENTS

Figure 1:
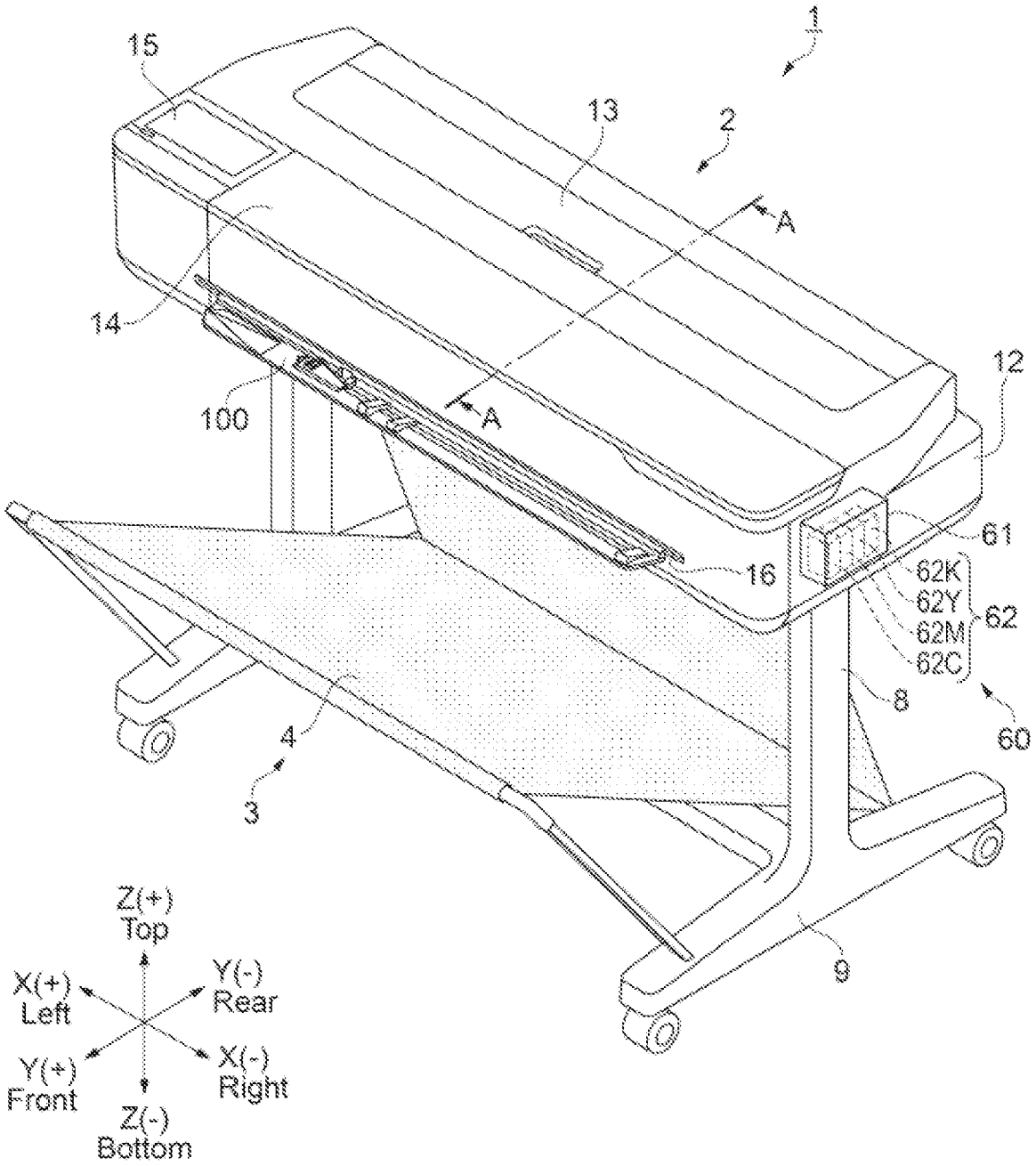
FIG. 1 is a perspective view of an inkjet printer.
Figure 2:
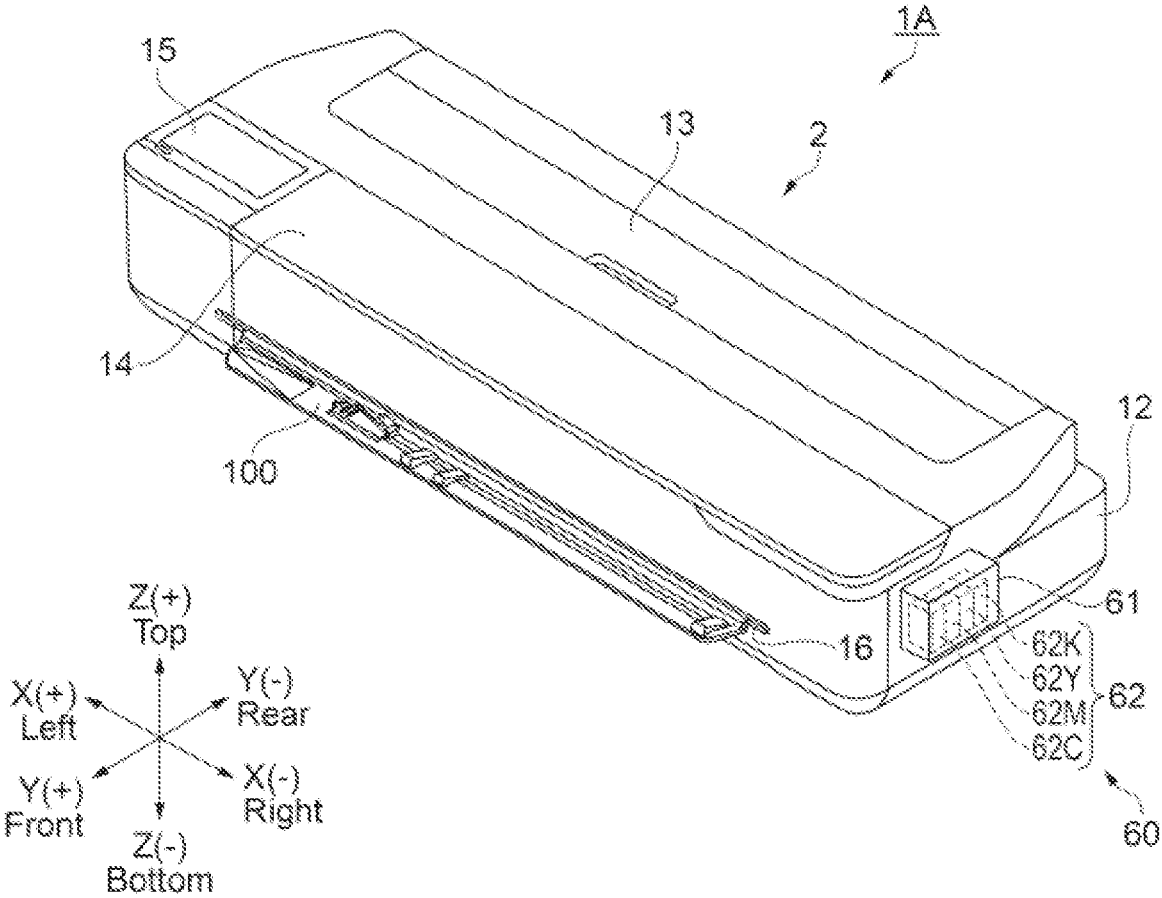
FIG. 2 is a perspective view of the inkjet printer.
Figure 3:
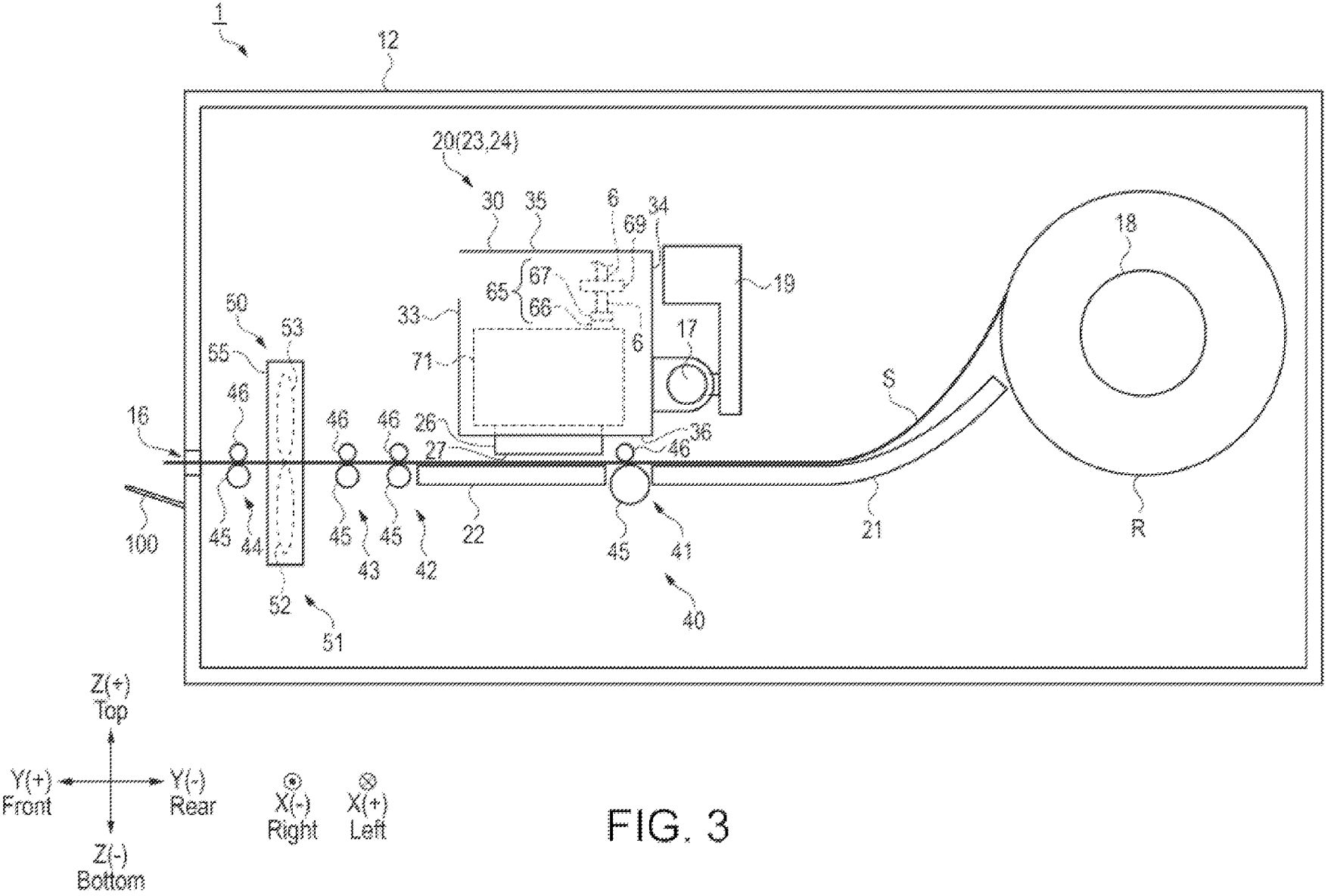
FIG. 3 schematically illustrates the configuration of the inkjet printer.

FIG. 1 is a perspective view of an inkjet printer 1. FIG. 2 is a perspective view of an inkjet printer 1A. FIG. 3 schematically illustrates the configuration of an inkjet printer 1.

In FIG. 1 to FIG. 3, the inkjet printer 1 is shown when placed on a horizontal surface. FIG. 3 is a section view through line A-A in FIG. 1, and schematically illustrates the configuration of the main unit 2 of the inkjet printer 1.

The basic configuration of an inkjet printer 1 according to this embodiment is described first below with reference to FIG. 1 to FIG. 3.

In the following description, the width of the inkjet printer 1 corresponds to the X-axis, the depth (direction from front to back) of the inkjet printer 1 corresponds to the Y-axis, and the height of the inkjet printer 1 corresponds to the Z-axis. The X-axis and Y-axis are axes on a horizontal plane, and the Z-axis is the vertical direction perpendicular to the horizontal plane.

The direction to one side on the X-axis is referred to as the +X direction, and the direction to the other side is referred to as the −X direction. The direction to one side on the Y-axis is referred to as the +Y direction, and the direction to the other side is referred to as the −Y direction. The direction to one side on the Z-axis is referred to as the +Z direction, and the direction to the other side is referred to as the −Z direction.

In this embodiment the +X direction is to the left, and the −X direction is to the right. The +Y direction is to the front, and the −Y direction is to the rear. The piezoelectric device is to the top, and the −Z direction is to the bottom. Note that in the figures the +X direction, −X direction, +Y direction, −Y direction, +Z direction, and −Z direction are indicated as X(+), X(−), Y(+), Y(−), Z(+), and Z(−).

Note further that in this embodiment the X-axis direction is the direction in which the carriage 30 described below moves. Also in this embodiment the −X direction is referred to as a first direction in which the carriage 30 moves, and the +X direction is referred to as a second direction.

As shown in FIG. 1, an inkjet printer 1 according to this embodiment is a printer capable of forming images on paper S. More specifically, the inkjet printer 1 is a printer capable of forming images on media of a relatively large size such as JIS A0 or B1 as the paper S. The inkjet printer 1 is also configured to form images on cut-sheet media such as A4 size media as the paper S.

The inkjet printer 1 has a main unit 2 and a discharged media receiver 3. The main unit 2 is disposed on top of a the +Z direction ends of legs 8 that rise from a base 9.

The discharged media receiver 3 includes a paper holder 4. The paper holder 4 is disposed on the −Z direction side of the main unit 2, and receives the paper S discharged from the main unit 2 side.

Note that as shown in FIG. 2, the inkjet printer 1A according to this embodiment may also be configured by just the main unit 2 without a discharged media receiver 3. More specifically, the inkjet printer 1A according to this embodiment may be configured as a desktop inkjet printer that can be placed and used on a desk or table.

Referring again to FIG. 1, the inkjet printer 1 has a basically rectangular printer case 12. On the top of the printer case 12, which is the surface of the printer case 12 on the +Z direction side, are disposed a supply cover 13 on the −Y direction side, and a maintenance cover 14 that can open and close at a position on the +Y direction side.

On the top of the printer case 12 on the +X direction side of the maintenance cover 14 is disposed an operating panel 15 enabling the user to perform various operations on the inkjet printer 1.

On the front, which is the +Y direction side surface of the printer case 12, is formed a paper exit 16 through which the paper S on which an image was recorded inside the printer case 12 can be discharged in the +Y direction. On the −Z direction side of the paper exit 16 is disposed a discharge table 100 that supports the paper S discharged from the paper exit 16.

An ink supply unit 60 is disposed on the side of the printer case 12 on the −X direction side. More specifically, the ink supply unit 60 is disposed on the outside of the printer case 12. The ink supply unit 60 includes a tank case 61 and multiple tanks 62 that are stored inside the tank case 61.

In this embodiment, there are four tanks 62 stored inside the tank case 61. Each of the four tanks 62 stores one of four colors of ink, cyan (C) ink, magenta (M) ink, yellow (Y) ink, and black (K) ink. In other words, inside the tank case 61 are tank 62C storing cyan (C) ink, tank 62M storing magenta (M) ink, tank 62Y storing yellow (Y) ink, and tank 62K storing black (K) ink.

Note that the number of tanks 62 held inside the tank case 61 is not limited to four, and there may be fewer than four or more than four. The number of colors of ink is also not limited to four, and there may be fewer than four colors or more than four colors.

The inks stored in the tanks 62 are aqueous inks having color agent dispersed (or dissolved) in an aqueous medium. This embodiment uses pigment as the color agent, but the color agent may be dye.

The solvent is, for example, an aqueous medium, and may be pure water or ultrapure water such as deionized water, ultrafiltered water, reverse osmosis water, or distilled water. If water that has been sanitized by ultraviolet radiation or adding hydrogen peroxide is used, the growth of mold and bacteria can be prevented when the ink is stored for a long time. The solvent may also contain an aqueous organic solvent such as ethylene glycol or propylene glycol.

The ink stored in the tanks 62 may also contain, in addition to color agent and solvent as described above, a basic catalyst, a surfactant, tertiary amine, resin, pH adjuster, buffer solution, fixer, preservatives, anti-oxidants or ultraviolet absorbers, chelating agent, or oxygen absorbers, for example.

An ink tube 6 is connected to the each of the four tanks 62C, 62M, 62Y, 62K as shown in FIG. 3. The ink tubes 6 pass through a through-hole (not shown in the figure) disposed in the printer case 12 and are routed through the printer case 12. The ink stored in the four tanks 62C, 62M, 62Y, 62K is supplied through the respective ink tube 6 to a head 26 disposed inside the printer case 12 as shown in FIG. 3.

The −X direction sides of the tank case 61 and tanks 62, that is, the surface on the opposite side of the tank case 61 and tanks 62 as the printer case 12, are transparent, enabling the user to see how much ink is stored in the tanks 62. A cap not shown is also disposed on the +Z direction side of the tanks 62.

The user can check the level of ink in the tanks 62 by looking through the −X direction side of the tank case 61 and tanks 62, and when the level of ink remaining in the tanks 62 gets low, can remove the cap and add ink to the tanks 62 as needed.

As shown in FIG. 3, a paper roll R of paper S wound into a roll is held inside the printer case 12. The paper roll R is supported rotatably on a spindle 18 that extends on the X-axis, which is also the direction across the width of the paper S. In this embodiment the paper S is unwound from the paper roll R by the spindle 18 turning the counterclockwise direction in FIG. 3. The unwound paper S is then conveyed by a conveyor 40, passes through the paper exit 16, which opens to the front of the printer case 12, and is discharged to the outside of the printer case 12. The path through which the unwound paper S is conveyed by the conveyor 40 to the paper exit 16 is the conveyance path, and the direction from the −Y direction side to the +Y direction side of the printer case 12, that is, the direction from the right to the left in FIG. 3, is the conveyance direction of the paper S conveyed by the conveyor 40.

The recording unit 20 includes a head 26 that ejects a fluid such as ink to the paper S; a subtank 71 as an ink storage unit; a carriage 30; a motor 23 that applies drive power capable of moving the carriage 30; an encoder 24 that detects the position of the carriage 30; and a guide rail 17 as a guide member.

The guide rail 17 is a straight member extending on the Y-axis. The guide rail 17 is supported by a frame 19 disposed inside the 12.

The carriage 30 is supported by the guide rail 17, and is configured movably by the motor 23 along the guide rail 17.

More specifically, the carriage 30 can move on the X-axis, which is the direction along the guide rail 17. Inside the carriage 30 are disposed the head 26, the subtank 71, a coupling member 65 that connects the ink tubes 6 to the subtank 71, and a filter 69. The head 26, the subtank 71, the coupling member 65, and the filter 69 can move with the carriage 30. The ink stored in the tanks 62C, 62M, 62Y, 62K is supplied to the head 26 through the ink tubes 6, filter 69, coupling member 65, and subtank 71. In other words, the ink supplied to the subtank 71 is passed through the ink tubes 6.

The coupling member 65 is a member that can be removed by the user. The user can disconnect the connection between the ink tubes 6 and the subtank 71 by disconnecting the coupling member 65 from at least one of the ink tube 6 and subtank 71.

Note that in this embodiment, the ink tubes 6 and subtank 71 contact the coupling member 65, and the ink tubes 6 and subtank 71 communicate through the coupling member 65, but it is not limited to the case that the ink tubes 6 and the subtank 71 contact the coupling member 65. More specifically, the coupling member 65 must simply enable the ink tubes 6 and subtank 71 to communicate through the coupling member 65, in other words, so that the coupling member 65 connects the ink tubes 6 with the subtank 71, and the coupling member 65 may make contact with a member that contacts the ink tubes 6 and a member that contacts the subtank 71.

The head 26 is located on the −Z direction side of the subtank 71. The head 26 is disposed so that the surface on the −Z direction side of the head 26 protrudes from the carriage 30. Nozzles 27 from which ink is ejected are formed in the surface of the head 26 on the −Z direction side. The head 26 comprises pressure generating chambers not shown, piezoelectric elements not shown, and the nozzles 27.

The nozzles 27 communicate with the subtank 71 through a flow channel not shown formed in the head 26.

The piezoelectric elements may be piezoelectric actuators that operate in a deflection vibration mode or piezoelectric actuators that operate in a longitudinal vibration mode. The piezoelectric element causes a vibrator that forms part of the pressure generating chamber to vibrate, producing a pressure change in the pressure generating chamber, and using this pressure change, ink is ejected from the nozzles 27 to the paper S.

The subtank 71 is located on the +Z direction side of the head 26. The subtank 71 is stored inside the carriage 30. The subtank 71 communicates through the flow channel formed in the head 26 with the nozzles 27 from which ink is ejected.

A subtank 71 that communicates with the nozzles 27 from which ink is ejected is mounted on the carriage 30 as described above, and the carriage 30 can move along the guide rail 17. The coupling member 65 and filter 69 are also carried on the carriage 30, and move with the carriage 30 along the guide rail 17.

Note that because the guide rail 17 is straight and extends along the X-axis in this embodiment, the direction of carriage 30 travel is along the guide rail 17, but the direction of carriage 30 movement is not so limited. For example, a rail member that forms a curve may be used as the guide member, and the direction in which the rail member extends may be the direction of carriage 30 movement.

A first support member 21 and a second support member 22 are configured by panel members. The first support member 21 is located upstream from the second support member 22 in the conveyance direction, and guides paper S unrolled from the paper roll R toward the recording unit 20. The second support member 22 is disposed opposite the head 26 of the recording unit 20.

The conveyor 40 conveys the paper S unwound from the paper roll R from inside the printer case 12 toward the paper exit 16 along the first support member 21 and second support member 22. The conveyor 40 includes a first conveyance roller pair 41, a second conveyance roller pair 42, a third conveyance roller pair 43, and a fourth conveyance roller pair 44 disposed sequentially from the upstream side to the downstream side in the conveyance direction. The first conveyance roller pair 41 is upstream in the conveyance direction from the head 26, and is located in the conveyance direction between the first support member 21 and second support member 22. The other conveyance roller pairs 42, 43, 44 are located downstream in the conveyance direction from the head 26.

The conveyance roller pairs 41, 42, 43, 44 each include a drive roller 45 capable of driving rotationally by means of a motor not shown, and a follower roller 46 capable of rotating following the rotation of the drive roller 45. The conveyance roller pairs 41, 42, 43, 44 convey the paper S by turning with the paper S held between the drive roller 45 and follower roller 46. The drive roller 45 contacts the paper S from the −Z direction side. The follower roller 46 contacts the paper S from the +Z direction side.

More specifically, when conveying the paper S, the follower roller 46 in each conveyance roller pair 42, 43, 44 contacts the surface of the paper S to which fluid is ejected. As a result, the follower roller 46 in each conveyance roller pair 42, 43, 44 is configured, for example, by a star wheel having a small contact area on the paper S to reduce degrading the quality of images recorded on the paper S. The conveyance roller pairs 41, 42, 43, 44 are also disposed with a specific space therebetween on the X-axis.

A cutting mechanism 50 is disposed btw the third conveyance roller pair 43 and fourth conveyance roller pair 44. The paper S cut by the cutting mechanism 50 is discharged from the paper exit 16 by conveyance by the fourth conveyance roller pair 44.

The fourth conveyance roller pair 44 is located downstream in the conveyance direction from the cutting mechanism 50 and near the paper exit 16. By disposing the fourth conveyance roller pair 44 near the paper exit 16, the paper S can be easily conveyed smoothly toward the paper exit 16. The occurrence of paper jams can thereby be prevented.

The open dimension (Z-axis dimension) of the paper exit 16 is set so that the user's fingers cannot be inserted from the paper exit 16 into the printer case 12.

The cutting mechanism 50 includes a cutter 51 for cutting the paper S, and a support member 55 that supports the cutter 51.

The cutter 51 is configured by a round drive knife 52 and a follower knife 53. The drive knife 52 and follower knife 53 are attached to the support member 55 in a manner enabling rotating relative to the support member 55. The drive knife 52 and follower knife 53 are aligned with each other vertically.

The support member 55 can move bidirectionally on the X-axis. The cutting mechanism 50 cuts the paper S with the cutter 51 by the support member 55 moving along the X-axis. More specifically, the cutting mechanism 50 including a cutter 51 cuts the paper S by scanning in the X-axis direction intersecting the conveyance direction of the paper S.

Note that the cutting mechanism 50 also has a motor or other drive source, and may be configured to move the cutting mechanism 50 bidirectionally on the X-axis by drive power from the motor, or the cutting mechanism 50 and carriage 30 may be linked to move the cutting mechanism 50 bidirectionally on the X-axis by drive power from the motor that moves the carriage 30.

Thus comprised, the inkjet printer 1 records (prints) images on the paper S by alternately repeating an operation whereby ink is ejected to the paper S from the nozzles 27 while the carriage 30 moves on the X-axis, and an operation whereby the paper S moves in the conveyance direction. As a result, when recording an image on the paper S, the carriage 30 repeatedly moves in the X-axis direction.

Figure 4:
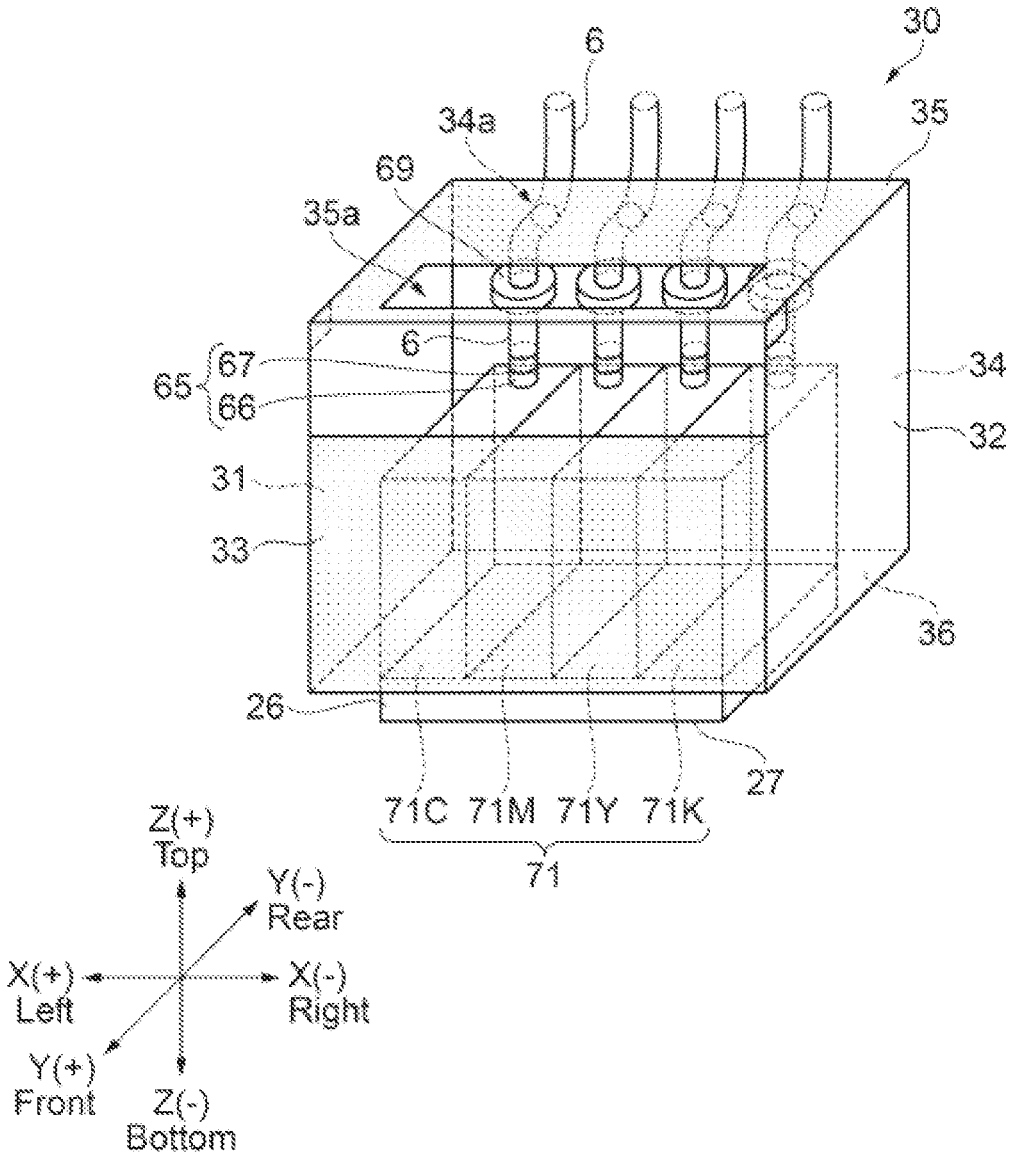
FIG. 4 is a perspective view of the carriage and components disposed to the carriage.
Figure 5:
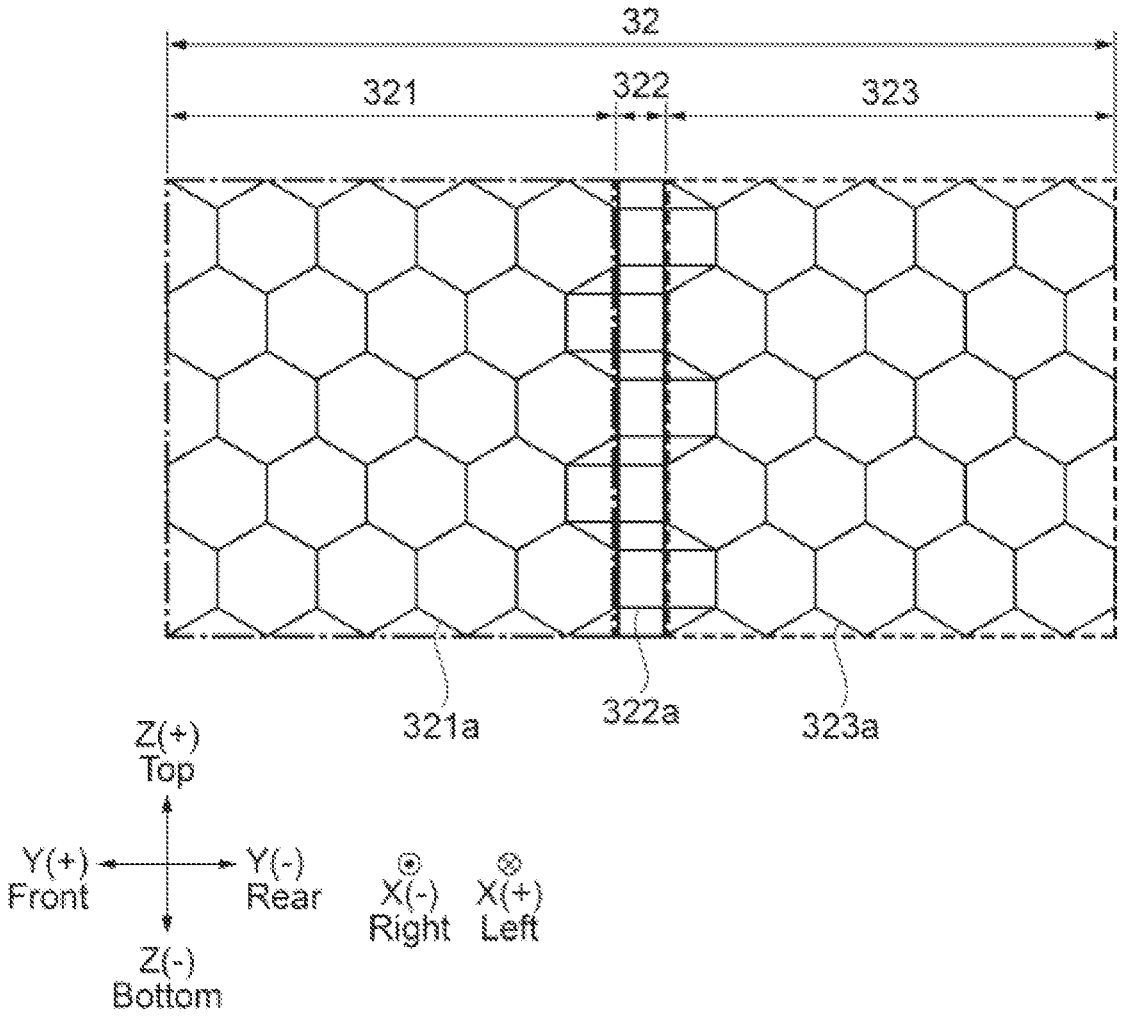
FIG. 5 schematically illustrates the configuration of the right wall of the carriage.
Figure 6:
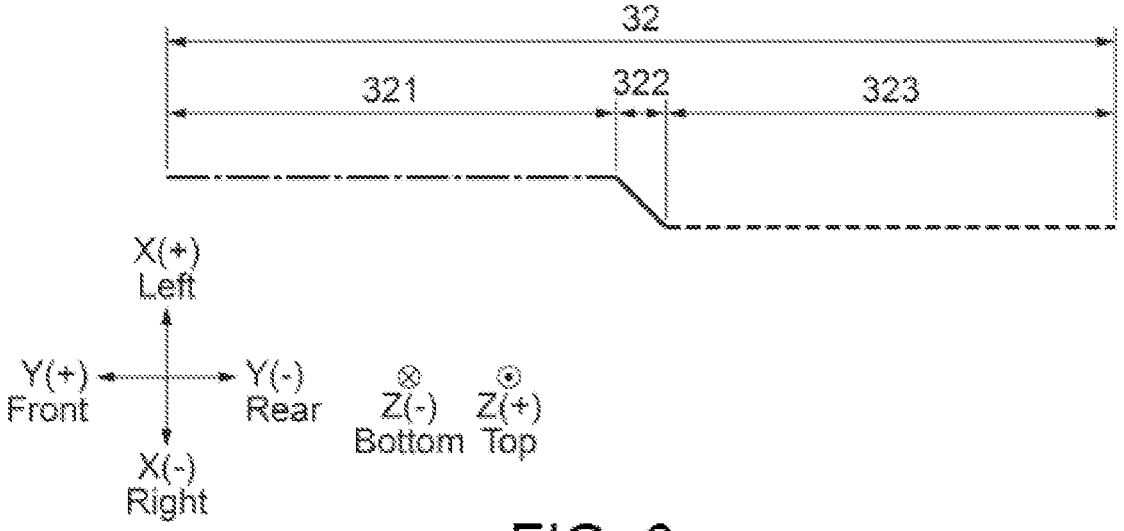
FIG. 6 schematically illustrates the configuration of the right wall of the carriage.

FIG. 4 is a perspective view of the carriage 30 and components disposed to the carriage 30. FIG. 5 and FIG. 6 schematically illustrate the configuration of the right wall 32 of the carriage 30.

Note that in FIG. 4 the front wall 33 and top wall 35 are shaded, and the other walls 31, 32, 34, 36 are not shaded. FIG. 5 schematically illustrates the configuration of the right wall 32 of the carriage 30 when viewed from the X-axis direction. FIG. 6 shows the right wall 32 of the carriage 30 when viewed from the Z-axis direction.

The carriage 30 and components mounted on the carriage 30 are described next with reference to FIG. 4 to FIG. 6.

As shown in FIG. 4, the carriage 30 has a left wall 31 on the +X direction side, a right wall 32 on the −X direction side, a front wall 33 on the +Y direction side, a rear wall 34 on the −Y direction side, a top wall 35 on the +Z direction side, and a bottom wall 36 on the −Z direction side.

The carriage 30 is a hollow member configured by the left wall 31, right wall 32, front wall 33, rear wall 34, top wall 35, and bottom wall 36, and the head 26, subtank 71, coupling member 65, and filter 69 are located therein.

The left wall 31, right wall 32, front wall 33, and rear wall 34 are located between the top wall 35 and bottom wall 36. The Z-axis dimension of the left wall 31 is the same as the Z-axis dimension of the rear wall 34. The Z-axis dimension of the front wall 33 is shorter than the Z-axis dimension of walls 31, 32, 34.

Because the Z-axis dimension of the front wall 33 is shorter than the Z-axis dimension of walls 31, 32, 34, a gap is formed between the front wall 33 and top wall 35 on the +Y direction side of the carriage 30.

Because the user can check the condition of the subtank 71 and coupling member 65 inside the carriage 30 through this gap, the user can easily check if there is a problem with the subtank 71 and coupling member 65.

An opening not shown (not shown in the figure) into which the head 26 can be fit is disposed in the bottom wall 36. The head 26 is fixed in position when fit into this opening in the bottom wall 36. When the head 26 is fit into the opening in the bottom wall 36, the surface of the head 26 on the −Z direction side, that is, the surface in which the nozzles 27 are formed, protrudes from the carriage 30 to the −Z direction side, opposing the second support member 22 or the paper S supported on the second support member 22.

The top wall 35 has an opening 35*a* on the +Y direction side.

On the +Y direction side the top wall 35 is supported by the left wall 31 and right wall 32. More specifically, on the +Y direction side the top wall 35 has a pair of curved parts that can contact the left wall 31 and right wall 32. The top wall 35 is supported by the left wall 31 and right wall 32 on this pair of curved parts, and can rotate at least in the +Z direction by pivoting on this pair of curved parts.

The user can check the condition of the subtank 71 and coupling member 65 housed inside the carriage 30 through this opening 35*a*. If there is a problem with the subtank 71 or coupling member 65, the user can swing the top wall 35 at least in the +Z direction to open the top wall 35, and take action to return the subtank 71 or coupling member 65 to the normal condition. An example of restoring the subtank 71 or coupling member 65 to normal condition is replacing the subtank 71.

When viewed in plan view along the Z-axis, the top wall 35 overlaps the coupling member 65. More specifically, when viewed in plan view along the Z-axis, the top wall 35 is disposed covering the coupling member 65.

In other words, the carriage 30 has a top wall 35 as a cover member that covers the coupling member 65 from the +Z direction side, which is the opposite side as the side where the subtank 71 is located. In other words, the coupling member 65 is interposed between the top wall 35 and the subtank 71 in the Z-axis. As a result, the coupling member 65 is protected by the top wall 35 on the +Z direction side, which is the opposite side as the side where the subtank 71 is located, making transmission of mechanical impact from the +Z direction side on the coupling member 65 difficult.

Inside the carriage 30, the right wall 32, as a first wall member, is located on the −X direction side of the coupling member 65, and the left wall 31, as a second wall member, is located on the +X direction side, that is, the opposite side as the −X direction side of the coupling member 65. More specifically, the carriage 30 has a right wall 32 located on the −X direction side of the coupling member 65 on the X-axis of carriage 30 movement, and a left wall 31 located on the +X direction side, the opposite side as the −X direction side, of the coupling member 65 on the X-axis of carriage 30 movement. In other words, the right wall 32 is at a position that is in the −X direction from the coupling member 65, and the left wall 31 is at a position that is in the +X direction. And the carriage 30 is move in the −X direction and in +X direction, which are along the X-axis.

In addition, in plan view from the X-axis side, the left wall 31 and right wall 32 overlap the coupling member 65. More specifically, when viewed from the +X direction side, the left wall 31 is disposed covering the coupling member 65, and when viewed from the −X direction side, the right wall 32 is disposed covering the coupling member 65. In other words, this embodiment is configured with the coupling member 65 superimposed with the right wall 32 and superimposed with the left wall 31 when viewed from the X-axis as the direction of carriage 30 movement.

As a result, the coupling member 65 is protected by the left wall 31 and right wall 32 on the X-axis along which the carriage 30 moves, and mechanical impact on the coupling member 65 is impeded from the +X direction side and the −X direction side. More specifically, when configured so that the coupling member 65 is superimposed with the right wall 32 and is superimposed with the left wall 31 when viewed from the X-axis as the direction of carriage 30 movement, mechanical impacts on the coupling member 65 from the +X direction side and the −X direction side are impeded. Unnecessary force transferring to the coupling member 65 is thereby impeded.

The front wall 33 of the carriage 30 is located on the +Y direction side of the coupling member 65, and the rear wall 34 is located on the −Y direction side of the coupling member 65. In addition, when viewed in plan view on the Y-axis, the front wall 33 and rear wall 34 also cover the coupling member 65. As a result, the coupling member 65 is protected by the front wall 33 and rear wall 34 on the Y-axis, which is intersects the X-axis on which the carriage 30 moves, and transfer of mechanical shocks from the Y-axis side to the coupling member 65 is difficult.

Four subtanks 71 are installed on the carriage 30. More specifically, the subtanks 71 include subtank 71C storing cyan (C) ink, subtank 71M storing magenta (M) ink, subtank 71Y storing yellow (Y) ink, and subtank 71K storing black (K) ink.

Note that the number of subtanks 71 carried on the carriage 30 is not limited to four, and there may be fewer than four or more than four.

The ink tubes 6 are made of plastic in this example, are flexible, and are reversibly deformable. Because the ink tubes 6 are flexible, the ink tubes 6 can be routed between the tanks 62 and carriage 30 as desired.

Four through-holes 34*a* through which the ink tubes 6 pass are formed in the rear wall 34 of the carriage 30. After being connected to the tanks 62, the ink tubes 6 are routed from the tanks 62 to the carriage 30, and inserted through the through-holes 34*a* in the rear wall 34 to the inside of the carriage 30. Each ink tube 6 inserted into the carriage 30 is connected to a subtank 71 through a coupling member 65.

As a result, the tanks 62 held in the tank case 61 communicate with the subtanks 71 through an ink tube 6 and a coupling member 65.

More specifically, the tank 62C storing cyan (C) ink communicates through an ink tube 6 and coupling member 65 with the subtank 71C storing cyan (C) ink. The tank 62M storing magenta (M) ink communicates through an ink tube 6 and coupling member 65 with the subtank 71M storing magenta (M) ink. The tank 62Y storing yellow (Y) ink communicates through an ink tube 6 and coupling member 65 with the subtank 71Y storing yellow (Y) ink. The tank 62K storing black (K) ink communicates through an ink tube 6 and coupling member 65 with the and subtank 71K storing black (K) ink.

Each ink tube 6 inserted into the carriage 30 is affixed by adhesive to the rear wall 34 (carriage 30) at the part of the ink tube 6 passing through the through-hole 34*a* in the rear wall 34, thereby limiting displacement of the ink tube 6. In addition, because the coupling member 65 is fastened to the subtank 71, the part of the ink tube 6 that contacts the coupling member 65 is fastened to the subtank 71, and displacement of the ink tube 6 is limited.

Note that the part of the ink tube 6 that is inserted through the through-hole 34*a* in the rear wall 34 is an example of the part that is fastened to the carriage. More specifically, this embodiment is configured with the part of the ink tube 6 that passes through the through-hole 34*a* fastened to the rear wall 34 of the carriage 30.

Note that the ink tube 6 is not limited to being fastened to the rear wall 34 of the carriage 30, and may instead be fastened to any of the other walls 31, 32, 33, 35, 36 of the carriage 30.

In addition, the ink tube 6 is not limited to being fastened to the rear wall 34 by adhesive, and the ink tube 6 may be attached to the rear wall 34 by adhesive tape, the ink tube 6 may be attached to the rear wall 34 by a binding member or tie, and the ink tube 6 may be attached to the rear wall 34 by a gripping member that can grip and hold the ink tube 6.

A filter 69 is also disposed to the ink tube 6 between the part of the ink tube 6 that passes through the through-hole 34*a* in the rear wall 34, and the end part that contacts the coupling member 65. More specifically, this embodiment is configured with a filter 69 that captures bubbles in the ink tube 6 between the part of the ink tube 6 attached to the carriage 30 and the coupling member 65.

In this way, the part of the ink tube 6 that passes through the through-hole 34*a* in the rear wall 34, and the end part that contacts the coupling member 65, are secured inside the carriage 30. Compared with a configuration whereby the ink tube 6 is not fastened to the carriage 30 at a part other than the coupling member 65, a configuration whereby the ink tube 6 is fastened to the carriage 30 at a part other than the coupling member 65 makes displacement of the ink tube 6 by movement of the carriage 30 on the X-axis more difficult, and makes impact of the ink tube 6 with the carriage 30 more difficult. The amount of displacement is also reduced, and application of excess force to the coupling member 65 is more difficult.

If the ink tube 6 strikes the carriage 30, contamination from the ink tube 6 may be produced by the collision. If impact between the ink tube 6 and carriage 30 is impeded, production of foreign matter by the collision will also be suppressed.

Because the filter 69 disposed inside the carriage 30 becomes heavier when filled with ink, the filter 69 hangs down due to its own weight inside the carriage 30. As a result, when the carriage 30 moves on the X-axis, the filter 69 swings like a pendulum pivoting on the part of the ink tube 6 that is secured inside the carriage 30.

Because the ink tube 6 is fastened to the carriage 30 at a part other than the coupling member 65 in this embodiment, the distance between the part of the ink tube 6 other than the coupling member 65 that is fastened and the filter 69 is shorter than a configuration in which the ink tube 6 is not fastened to the carriage 30 at a part other than the coupling member 65, and the range in which the filter 69 can swing like a pendulum is narrower.

As a result, the range of movement of the ink tube 6 between the pivot point and the filter 69 is also narrower, collision of the ink tube 6 with the carriage 30 is more difficult, and production of foreign matter by the collision is suppressed.

Furthermore, if the distance between the pivot point and the filter 69 is short, the force of the filter 69 acting on the ink tube 6 is weaker than when the distance between the pivot point and the filter 69 is long. Application of excess force from the ink tube 6 on the coupling member 65 is therefore impeded. Application of excess force to the coupling member 65 may have adverse effects such as ink leaking from the coupling member 65, and preventing such excess force helps prevent such problems.

As described above, when the user checks the status of ink stored in the tanks 62 and confirms the ink level in the tanks 62 is low, the user can add ink to the tanks 62. However, when the user adds ink to the tanks 62, bubbles can also be easily added to the tanks 62. If ink mixed with bubbles is supplied to the head 26, and the piezoelectric element is driven to change the pressure in the pressure chamber, the bubbles can interfere with a change in pressure, and ink may not be desirably ejected from the nozzles 27 to the paper S. As a result, the quality of the images recorded on the paper S drops.

The ink tube 6 therefore has a filter 69 that captures bubbles mixed with ink inside the ink tube 6. In other words, this embodiment is configured with a filter 69 that captures bubbles in the ink tube 6 disposed to the ink tube 6. Because the filter 69 is preferably disposed near the head 26 to suppress the adverse effects of bubbles, the filter 69 is disposed with the head 26 and subtank 71 inside the carriage 30.

The coupling member 65 is a one-touch coupling, and is configured by a first coupling member 66 and a second coupling member 67. The first coupling member 66 is fastened to the subtank 71, and the second coupling member 67 is fastened to the ink tube 6.

For example, the first coupling member 66 has a concave coupling part, and the second coupling member 67 has a convex coupling part. The user can connect the second coupling member 67 and first coupling member 66 by inserting the convex coupling part of the second coupling member 67 to the concave coupling part of the first coupling member 66. More specifically, the user can connect the ink tube 6 and subtank 71 easily with few steps through the coupling member 65.

Because the coupling member 65 is a one-touch coupling, connection is easier than with other coupling methods (such as welding), and the coupling can be easily disconnected. For example, the subtank 71 and ink tube 6 can be easily replaced by disconnecting the connection through the coupling member 65.

Because the ink tube 6 is flexible, the ink tube 6 can be routed as desired between the tank case 61 and carriage 30.

Because the carriage 30 moves repeatedly in the +X direction and −X direction, the ink tube 6 connected to the coupling member 65 also moves repeatedly in the +X direction and −X direction. When the ink tube 6 moves repeatedly in the +X direction and −X direction, the position of the ink tube 6 may change. The position of the ink tube 6 may also change as a result of irregular operations such as printer overhauls and repairs.

Depending on the changed position of the ink tube 6, when the carriage 30 moves on the X-axis the ink tube 6 may collide with the coupling member 65, and excess force may be applied to the coupling member 65. An ink tube 6 that shifted in position due to irregular operations such as printer overhauls and repairs may also collide with the coupling member 65 and excess force may be applied to the coupling member 65.

Furthermore, if parts or tools used for overhauls or repairs are left in the printer case 12, when the carriage 30 moves on the X-axis the parts or tools may collide with the coupling member 65, and excess force may be applied to the coupling member 65.

Because the coupling member 65 is a one-touch coupling, the ink tube 6 and subtank 71 can be easily connected. The mechanical strength of the coupling member 65 is also weaker than other coupling methods such as welding. When and excess force is applied to the coupling member 65, the first coupling member 66 and second coupling member 67 may disconnect from each other.

If excess force is applied to the coupling member 65 and the first coupling member 66 and second coupling member 67 disconnect, ink may leak from where the first coupling member 66 and second coupling member 67 disconnect, ink may leak and spread inside the printer case 12, and parts inside the printer case 12 will become soiled. Parts soiled by ink may also fail, and replacing parts may be necessary.

If excess force is applied to the coupling member 65, the first coupling member 66 and second coupling member 67 disconnect, and ink leaks and spreads inside the printer case 12, the inkjet printer 1 may also malfunction. If the inkjet printer 1 malfunctions, unexpected work to restore the inkjet printer 1 to normal operating condition becomes necessary. Such unexpected work may include, for example, cleaning the parts where the leaked ink spread, and replacing malfunctioning parts. Such unexpected work may also require much time and effort, as well as great cost.

In this embodiment, the right wall 32 is located on the −X direction side of the coupling member 65, and the left wall 31 is located on the +X direction side of the coupling member 65. In addition, in plan view from the X-axis side, the left wall 31 and right wall 32 are superimposed on the coupling member 65, the left wall 31 covers the coupling member 65 from the −X direction side, and the right wall 32 covers the coupling member 65 from the +X direction side.

As a result, when there is an obstruction that interferes with movement of the carriage 30, the obstruction collides with the left wall 31 or right wall 32, and collision with the coupling member 65 is prevented. More specifically, the obstruction is moved by the left wall 31 or right wall 32 to a position where it does not interfere with movement of the carriage 30, and the chance of collision between the coupling member 65 and the obstruction is reduced. Collision of the obstruction with the left wall 31 or right wall 32 is also detected by the encoder 24, and by stopping the carriage 30, the chance of collision between the coupling member 65 and the obstruction is reduced.

Therefore, even if the position of the ink tube 6 changes, and the ink tube 6 is at a position that interferes with movement of the carriage 30, when the carriage 30 moves on the X-axis, contact between the ink tube 6 and the coupling member 65 is difficult, application of excess force from the ink tube 6 to the coupling member 65 is difficult, and problems such as the first coupling member 66 and second coupling member 67 disconnecting are impeded.

In addition, even if parts, tools, or other obstructions that interfere with movement of the carriage 30 result from irregular tasks such as overhauls or repairs, when the carriage 30 moves on the X-axis, contact between the obstruction and coupling member 65 is difficult, application of excess force from the obstruction to the coupling member 65 is difficult, and problems such as the first coupling member 66 and second coupling member 67 disconnecting are impeded.

In this embodiment, the coupling member 65 is protected by the top wall 35 on the +Z direction side, which is the opposite side as the subtank 71, is protected by the left wall 31 and right wall 32 on the X-axis on which the carriage 30 moves, and is protected by the front wall 33 and rear wall 34 on the Y-axis intersecting the X-axis on which the carriage 30 moves.

Therefore, even if irregular work such as printer overhauls and repairs involve a tool, for example, touching the carriage 30, application of excess force on the coupling member 65 during such work is difficult, and problems such as the first coupling member 66 and second coupling member 67 disconnecting are prevented, because the coupling member 65 is protected by the walls 31, 32, 33, 34, 35.

Furthermore, when movement of the carriage 30 is impeded by an obstruction, an inkjet printer 1 according to this embodiment can detect obstruction of carriage 30 movement.

More specifically, the encoder 24 detects the location of the carriage 30, and a controller not shown of the inkjet printer 1 calculates, based on information from the encoder 24, the distance and speed of carriage 30 travel on the X-axis. The controller also detects interference of carriage 30 movement from the distance and speed of carriage 30 travel, and informs the user.

When the user investigates the cause of carriage 30 movement being obstructed, and determines the ink tube 6 is the obstruction, the user can adjust the position of the ink tube 6 so that the ink tube 6 does not collide with the carriage 30, and if the obstruction is a part or tool used in an irregular maintenance task, can remove the part or tool.

This configuration prevents the carriage 30 and obstruction from repeatedly colliding and, compared with when the carriage 30 and obstruction repeatedly collide, makes application of excess force to the coupling member 65 more difficult, and helps prevent problems such as the first coupling member 66 and second coupling member 67 disconnecting due to excess force. A drop in image quality resulting from interference with the movement of the carriage 30 can also be suppressed.

Note that collisions between the carriage 30 and an obstruction can also be detected by observing the load on the motor 23 that applies drive power enabling the carriage 30 to move. More specifically, the controller may be configured to detect collisions between the carriage 30 and an obstruction based on the load on the motor 23, and inform the user.

In FIG. 5 and FIG. 6 a first part 321 of the right wall 32 is indicated by a bold dot-dash line, a second part 322 of the right wall 32 is indicated by a bold solid line, and a third part 323 of the right wall 32 is indicated by a bold dotted line.

As shown in FIG. 5 and FIG. 6, the right wall 32 has a first part 321 on the +Y direction side, a third part 323 on the −Y direction side, and a second part 322 between the first part 321 and third part 323.

As shown in FIG. 6, the first part 321 of the right wall 32 protrudes to the +X direction side of the third part 323. The first part 321 follows a plane perpendicular to the X-axis on which the carriage 30 moves, that is, a plane including the Y-axis and Z-axis directions. The third part 323 protrudes from the first part 321 to the −X direction. The third part 323 also follows a plane perpendicular to the X-axis on which the carriage 30 moves, that is, a plane including the Y-axis and Z-axis directions.

The second part 322 of the right wall 32 is the part connecting the first part 321 and third part 323. The second part 322 intersects a plane including the Y-axis and Z-axis directions, which is a plane perpendicular to the X-axis on which the carriage 30 moves. In other words, the second part 322 is at an angle to the plane perpendicular to the X-axis on which the carriage 30 moves. More specifically, the second part 322 is a slope that is inclined to the plane perpendicular to the X-axis on which the carriage 30 moves.

The right wall 32 thus has a slope that is inclined to the plane perpendicular to the X-axis on which the carriage 30 moves.

As shown in FIG. 5, a honeycombed rib (protrusion) 321*a* is disposed to the first part 321. A honeycombed rib (protrusion) 323*a* is also disposed to the third part 323.

A rib 322*a* that connects the rib 321*a* of the first part 321 and the rib 323*a* of the third part 323 is disposed to the second part 322. When viewed along the X-axis, the rib 322*a* of the second part 322 extends in the Y-axis direction. The second part 322 has multiple ribs 322*a* extending in the Y-axis direction disposed on the Z-axis. More specifically, the part of the rib 322*a* of the second part 322 extending in the Y-axis direction has multiple striped shapes arrayed along the Z-axis.

Because honeycomb shaped ribs 321*a* and 323*a*, and stripe-shaped ribs 322*a* are disposed to the right wall 32, the mechanical strength of the right wall 32 and the impact resistance of the right wall 32 are greater than a configuration not having ribs 321*a*, 322*a*, and 323*a*.

More specifically, the ribs 321*a*, 322*a*, 323*a* disposed to the right wall 32 are an example of an impact resistance structure. By the right wall 32 having ribs 321*a*, 322*a*, 323*a* as an impact resistance structure, the mechanical strength and the impact resistance of the right wall 32 are greater than a configuration not having such a structure.

Note that ribs 321*a*, 322*a*, 323*a* are disposed to the right wall 32 in this embodiment, but the configuration that increases the mechanical strength and the impact resistance of the right wall 32 is not limited to a configuration having ribs 321*a*, 322*a*, 323*a*. For example, the right wall 32 may be configured with a member of multiple layers as the configuration that increases the mechanical strength and the impact resistance of the right wall 32.

When the position of the ink tube 6 changes in the inkjet printer 1 and the carriage 30 moves in the −X direction, the ink tube 6 may collide with the right wall 32 located at the −X direction side of the carriage 30. When the ink tube 6 collides with the right wall 32, the position of the ink tube 6 may also change due to the collision, and the ink tube 6 may become entangled with the carriage 30. If the ink tube 6 becomes wrapped with the carriage 30, movement of the carriage 30 is strongly impeded, and a strong unwanted force may work on the coupling member 65.

When a rib 322*a* is disposed to the second part 322 inclined to the −X direction, the contact area between the second part 322 and ink tube 6 becomes smaller compared with a configuration in which the second part 322 does not have a rib 322*a*, and the ink tube 6 can slide more easily over the second part 322 than in a configuration in which the contact area between the second part 322 and ink tube 6 is large. Furthermore, because the second part 322 inclines to a plane perpendicular to the X-axis on which the carriage 30 travels, the ink tube 6 can move along the slope of the second part 322.

The second part 322 thus controls the direction in which the ink tube 6 moves when the ink tube 6 collides with the right wall 32. When the ink tube 6 collides with the right wall 32, the ink tube 6 moves in the direction of the slope of the second part 322.

In this embodiment, the direction of the slope of the second part 322 is set to control the direction of ink tube 6 movement to the direction in which it is more difficult for the ink tube 6 to become entangled with the carriage 30.

As a result, it is more difficult for the ink tube 6 to become entangled with the carriage 30 when the carriage 30 moves in the −X direction and the ink tube 6 collides with the right wall 32, and problems resulting from the ink tube 6 being entangled with the carriage 30 can be suppressed. Problems resulting from the ink tube 6 being entangled with the carriage 30 include interference with movement of the carriage 30, and unwanted force working on the coupling member 65.

Furthermore, because the mechanical strength and impact resistance of the right wall 32 are high, it is more difficult for the mechanical impact of the ink tube 6 striking the right wall 32 to mechanically damage the right wall 32.

Furthermore, if parts or tools used for overhauls or repairs are left in the printer case 12, and the parts or tools collide with the right wall 32, the direction in which the parts or tools that collided with the right wall 32 move is controlled in the same way as when the ink tube 6 collides with the right wall 32, and adverse effects of the parts or tools left inside the printer case 12 can be suppressed compared with a configuration in which the direction in which the parts or tools that collided with the right wall 32 move is not controlled. Examples of such adverse effects include interfering with the movement of the carriage 30, and application of unwanted force to the coupling member 65.

Furthermore, because the mechanical strength and impact resistance of the right wall 32 are high, it is more difficult for the mechanical impact of parts or tools striking the right wall 32 to mechanically damage the right wall 32.

While not described in detail above, the left wall 31 located on the +X direction side of the carriage 30 also has honeycomb shaped ribs, striped ribs, and a slope as an impact resistance structure identical to the right wall 32 located on the −X direction side of the carriage 30. The left wall 31 on the +X direction side of the carriage 30 has the same effect as the right wall 32 located on the −X direction side of the carriage 30.

For example, when the carriage 30 moves in the +X direction and the ink tube 6 hits the left wall 31, it is more difficult for the ink tube 6 to become entangled with the carriage 30, and problems resulting from the ink tube 6 being entangled with the carriage 30 can be suppressed.

Note that in this embodiment, both the left wall 31 and right wall 32 have an impact resistant structure, but configurations in which only one has an impact resistant structure are possible.

The invention is not limited to the foregoing embodiments, can be varied in many ways without departing from the scope and concept of the invention as will be understood from the accompanying claims and foregoing description, and various modifications of the foregoing embodiments are conceivable. Examples of some variations are described below.

Variation 1

Figure 7:
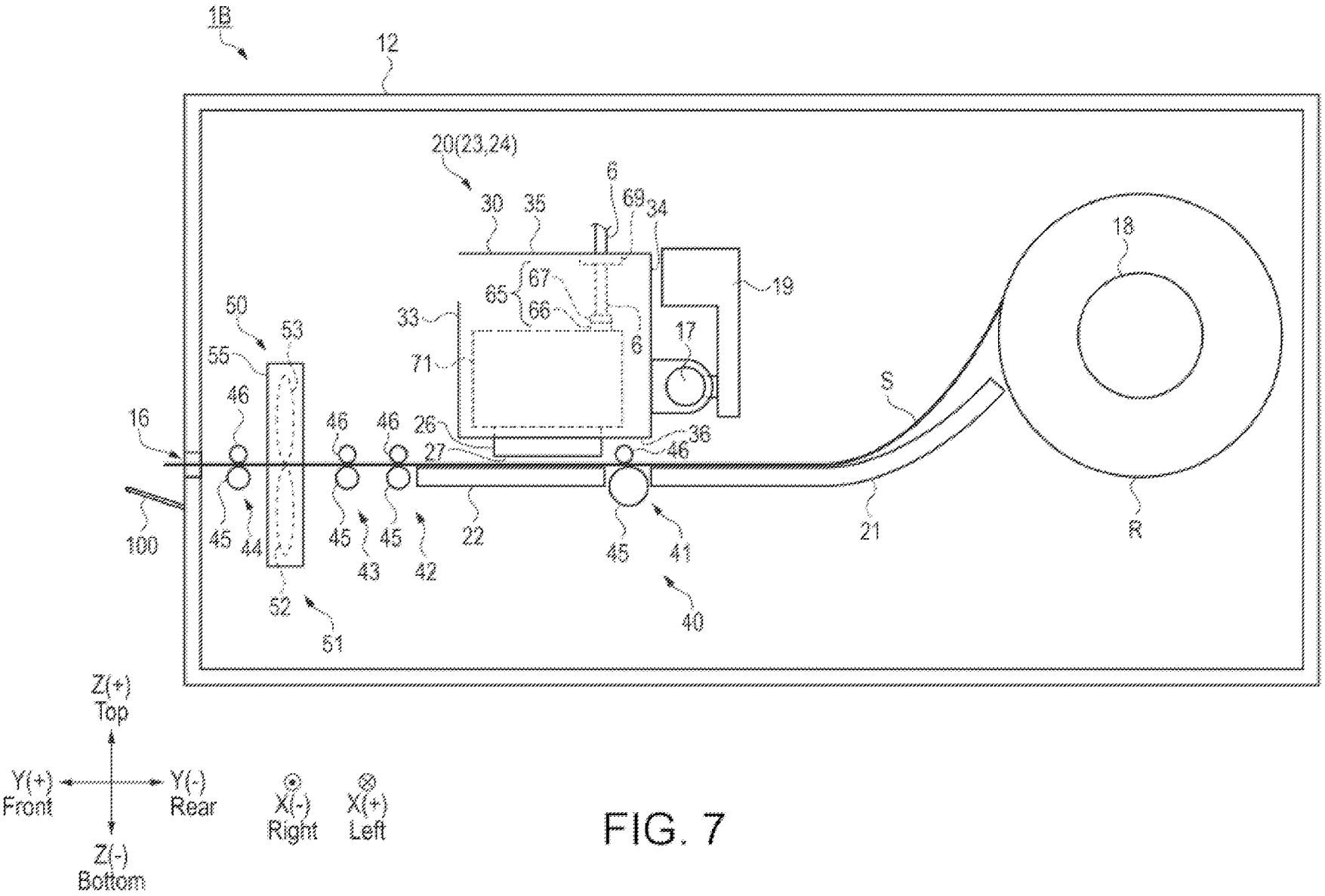
FIG. 7 schematically illustrates the configuration of an inkjet printer according to another embodiment.

FIG. 7 corresponds to FIG. 3, and schematically illustrates the configuration of a printer according to a first variation. The printer 1B according to this first variation and the printer 1 according to the first embodiment differ in the configuration of the filter 69, and are otherwise identical.

The configuration of the printer 1B according to this example is described below focusing on the differences with the printer 1 of the embodiment described above. In addition, like parts in this and the foregoing embodiment are identified by the same reference numerals, and redundant description is omitted.

As shown in FIG. 7, in the printer 1B according to this example the filter 69 is fastened to the top wall 35 of the carriage 30 by adhesive. In the inkjet printer 1 according to the first embodiment, the filter 69 is not fastened to the top wall 35 of the carriage 30. This is the difference between the printer 1B according to this example and the inkjet printer 1 of the foregoing embodiment. The tanks 62 in the tank case 61 communicate with the subtanks 71 through ink tubes 6 and coupling members 65.

This example is thus configured with a filter 69 that captures bubbles in the ink tube 6 disposed to the ink tube 6 with the filter 69 attached to the top wall 35 of the carriage 30.

Note that the filter 69 is not limited to being fastened to the top wall 35 of the carriage 30, and may instead be fastened to any of the other walls 31, 32, 33, 34, 36 of the carriage 30.

In addition, the filter 69 is not limited to being fastened to the top wall 35 by adhesive, and the filter 69 may be attached to the top wall 35 by adhesive tape, the filter 69 may be attached to the top wall 35 by a binding member or tie, and the filter 69 may be attached to the top wall 35 by a gripping member that can grip and hold the filter 69.

When the filter 69 is fastened to the top wall 35, it is more difficult for the filter 69 to swing like a pendulum when the carriage 30 moves on the X-axis than in a configuration in which the filter 69 is not fastened to the top wall 35. As a result, the ink tube 6 is also less susceptible to swinging, the ink tube 6 is less likely to collide with the carriage 30, and production of foreign matter by the collision is suppressed. Application of excess force from the filter 69 through ink tube 6 on the coupling member 65 is also impeded, and problems caused by excess force working on the coupling member 65 are impeded.

Variation 2

As described above, by providing a right wall 32 on the −X direction side of the coupling member 65 and a left wall 31 on the +X direction side of the coupling member 65, it is difficult for obstructions that may be present on the X-axis on which the carriage 30 travels to collide with the coupling member 65, and application of unwanted force on the coupling member 65 is also impeded.

More specifically, to suppress problems caused by obstructions on the X-axis on which the carriage 30 travels, it is important to provide a right wall 32 on the −X direction side of the coupling member 65 and a left wall 31 on the +X direction side of the coupling member 65.

In the examples above, the left wall 31 and right wall 32 completely overlap the coupling member 65 in plan view from the +X direction side or −X direction side, the left wall 31 is positioned to cover all of the coupling member 65 from the +X direction side, and the right wall 32 is positioned to cover all of the coupling member 65 from the −X direction side.

For example, the left wall 31 and right wall 32 may be disposed to cover part of the coupling member 65 in plan view from the +X direction side or −X direction side, the left wall 31 is positioned to cover part of the coupling member 65 from the +X direction side, and the right wall 32 is positioned to cover part of the coupling member 65 from the −X direction side. This configuration also suppresses problems caused by obstructions on the X-axis on which the carriage 30 travels in the main scanning direction.

When the left wall 31 and right wall 32 completely overlap the coupling member 65 in plan view from the +X direction side or −X direction side, problems caused by obstructions present on the X-axis on which the carriage 30 travels can be more effectively suppressed than a configuration in which the left wall 31 and right wall 32 overlap only part of the coupling member 65.

For example, a configuration in which the top wall 35 does not cover the coupling member 65 when viewed in plan view from the +Z direction is also conceivable. More specifically, a configuration in which the top wall 35 does not cover the coupling member 65 when viewed in plan view on the Z-axis is possible.

For example, the carriage 30 may be configured without a top wall 35 disposed on the +Z direction side perpendicular to the main scanning direction.

By disposing the left wall 31 and right wall 32 on the X-axis side of the coupling member 65, this configuration can also suppress problems caused by obstructions present on the X-axis on which the carriage 30 travels.

The embodiments described above can be summarized as follows.

An inkjet printer according to the disclosure has a carriage that moves along a guide member and has mounted thereon ink storage that communicates with a nozzle from which ink is ejected; an ink tube through which ink supplied from the ink storage passes; and a coupling member that connects the ink storage and the ink tube. The carriage has a first wall located on a first direction side of the coupling member in a direction of carriage movement, and a second wall located on a second direction side of the coupling member opposite the first direction side of carriage movement, and when viewed in a direction of carriage movement, the coupling member is superimposed with the first wall and is superimposed with the second wall.

In an inkjet printer according to the disclosure, a first wall is disposed on a first direction side of the coupling member in a direction of carriage movement, and a second wall is disposed on a second direction side of the coupling member in a direction of carriage movement, and when viewed in a direction of carriage movement, the first wall and the second wall cover the coupling member.

As a result, when there is an obstruction in the first direction in which the carriage moves and the carriage moves in the first direction, the obstruction collides with the first wall, and impact with the coupling member is difficult. When there is an obstruction in the second direction in which the carriage moves and the carriage moves in the second direction, the obstruction collides with the second wall, and impact with the coupling member is difficult.

More specifically, even if there is an obstruction in the direction in which the carriage moves, it is difficult for the obstruction to collide with the coupling member when the carriage moves because the carriage is protected by the first wall and second wall in the direction in which the carriage moves. Therefore, it is difficult for unwanted force due to a collision between the obstruction and coupling member to act on the coupling member, disconnection of the ink storage and ink tube connection by the coupling member is impeded.

The carriage in an inkjet printer according to the disclosure may have a cover member that covers the coupling member on the opposite side as the side on which the ink storage is located.

Because the coupling member is protected by the cover member on the opposite side of the coupling member as the side on which the ink storage is located, when maintenance, repair, or other irregular task is performed, it is difficult for unwanted force to act on the coupling member from the opposite side of the coupling member as the side on which the ink storage is located, and disconnection of the ink storage and ink tube connection by the coupling member is impeded.

An inkjet printer according to the disclosure may have a filter that captures bubbles in the ink tube disposed to the ink tube, and the filter is fastened to the carriage.

When the filter is fastened to the carriage, it is difficult for the filter to swing inside the carriage when the carriage moves. Because the filter and ink storage are connected through an ink tube and coupling member, it is difficult for the filter to swing inside the carriage and it is difficult for the ink tube connected to the filter to swing.

As a result, when the carriage moves, the ink tube is impeded from striking the carriage, and foreign matter produced by the ink tube and carriage colliding is suppressed. Unwanted force acting on the coupling member through the ink tube is also suppressed.

In an inkjet printer according to the disclosure, the ink tube may be fastened to the carriage.

Further, the ink tube may be fastened to the carriage at two places, where the ink tube connects to the coupling member, and a place other than where the ink tube connects to the coupling member. By the ink tube being fastened at two places to the carriage, the ink tube is more effectively prevented form swinging inside the carriage than when the ink tube is fastened to the carriage at only one location.

An inkjet printer according to another aspect of the disclosure may have a filter that captures bubbles in the ink tube is disposed to the ink tube between the part of the ink tube fastened to the carriage and the coupling member.

When the carriage 30 moves, the filter swings like a pendulum pivoting on the part of the ink tube that is fastened to the carriage or the part connected to the coupling member. More specifically, change in the position of the filter is limited by the part that is fastened to the carriage or the part connected to the coupling member.

When change in the position of the filter is limited by the part that is fastened to the carriage or the part connected to the coupling member, change in the position of the ink tube connected to the filter is less, and collision between the ink tube and the carriage is less likely, than when change in the position of the filter is not limited. It is also difficult for unwanted force to act on the coupling member through the ink tube.

In an inkjet printer according to another aspect of the disclosure, the first wall may have a slope that inclines to the plane perpendicular to the direction of carriage movement.

When there is an obstruction in the first direction in which the carriage moves, the carriage moves in the first direction, and the obstruction collides with the first wall, the obstruction moves in the direction of the incline of the slope. More specifically, the slope controls the direction in which the obstruction that collided with the first wall moves. In addition, when the obstruction moves to a position where collision with the first wall is difficult, it is difficult for the obstruction to repeatedly collide with the first wall when the carriage moves repeatedly in the first direction and second direction.

An inkjet printer according to another aspect of the disclosure embodiment may have ribs formed on the slope.

When ribs are disposed to the slope, the contact area between the obstruction and the slope when an obstruction collides with the first wall is smaller than when the slope does not have ribs, and the obstruction moves more easily in the direction of the incline of the slope than when the contact area between the obstruction and the slope is large.

In an inkjet printer according to another aspect of the disclosure, the first wall may have an impact resistant structure.

When the first wall has an impact resistant structure, mechanical damage to the first wall is less likely when an obstruction collides with the first wall than when the first wall does not have an impact resistant structure.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An inkjet printer comprising:

an ink storage that communicates with a nozzle from which ink is ejected;

a carriage that moves along a guide member and has the ink storage mounted thereon, the carriage includes a cover member;

an ink tube through which ink supplied to the ink storage passes;

a coupling member that connects the ink storage and the ink tube, the cover member covering the coupling member; and a filter configured to capture bubbles in the ink tube, the filter being external to the ink storage and disposed between the coupling member and the cover member and inline of a flow of ink to the ink storage; wherein the carriage has a first wall located at a position that is in a first direction from the coupling member, and a second wall located at a position that is in a second direction from the coupling member, the first direction and the second direction being along the direction of carriage movement, and the second direction being opposite the first direction, when viewed in the direction of carriage movement, the coupling member is superimposed with the first wall and is superimposed with the second wall, the coupling member being interposed between the cover member and the ink storage.

2. The inkjet printer described in claim 1, wherein:

the filter is fastened to the carriage.

3. The inkjet printer described in claim 1, wherein:

the ink tube is fastened to the carriage.

4. The inkjet printer described in claim 1, wherein:

the first wall has a slope that inclines to a plane perpendicular to the direction of carriage movement.

5. The inkjet printer described in claim 4, wherein:

the slope has a rib.

6. The inkjet printer described in claim 1, wherein:

the first wall has an impact resistant structure.

* * * * *